United States Patent [19]

Whitham

[11] Patent Number: 4,629,938

[45] Date of Patent: Dec. 16, 1986

[54] STANDING WAVE LINEAR ACCELERATOR HAVING NON-RESONANT SIDE CAVITY

[75] Inventor: Kenneth Whitham, San Diego, Calif.

[73] Assignee: Varian Associates, Inc., Palo Alto, Calif.

[21] Appl. No.: 717,351

[22] Filed: Mar. 29, 1985

[51] Int. Cl.[4] ..... H01J 25/00

[52] U.S. Cl. ..... 315/5.41; 315/5.42

[58] Field of Search ..... 315/5.41, 5.42

[56] References Cited

U.S. PATENT DOCUMENTS

| | | | |
|---|---|---|---|
| 4,286,192 | 8/1981 | Tanabe et al. | 315/5.41 |
| 4,382,208 | 5/1983 | Meddaugh et al. | 315/5.41 |
| 4,400,650 | 8/1983 | Giebeler, Jr. | 315/5.41 |

*Primary Examiner*—James C. Yeung

*Attorney, Agent, or Firm*—Stanley Z. Cole; Kenneth L. Warsh

[57] ABSTRACT

A linear accelerator includes cascaded standing wave main cavities with approximately the same resonant frequency and plural side cavities. A charged particle beam travels longitudinally through the main cavities. An electromagnetic wave excites the cavities with a frequency that is approximately the same as the resonant frequency of the main cavities. There is normally a fixed electromagnetic energy phase shift in adjacent main cavities. The resonant frequency of at least one side cavity is adjusted so it differs from the electromagnetic wave frequency. The detuned side cavity resonant frequency causes: (a) a change in the normal fixed phase shift of the main cavities adjacent the one side cavity and (b) a decrease in electric field strength in cavities electromagnetically downstream of the one side cavity relative to the electric field strength in cavities electromagnetically upstream of the one side cavity. In different embodiments, the electromagnetic wave is injected into a cavity where the particle beam is upstream and downstream of the one side cavity, respectively.

11 Claims, 6 Drawing Figures

STANDING WAVE LINEAR ACCELERATOR HAVING NON-RESONANT SIDE CAVITY

TECHNICAL FIELD

The present invention relates generally to standing wave linear particle beam accelerators and more particularly to charged particle beam accelerators and methods wherein a side cavity of such an accelerator has a resonant frequency that is adjusted so it differs from the frequency of an electromagnetic wave coupled to the accelerator to cause a change in a normal fixed phase shift of main cavities adjacent the side cavity and a decrease in electric field strength in cavities electromagnetically downstream of the side cavity.

BACKGROUND ART

Standing wave linear particle beam accelerators are characterized by plural cascaded standing wave electromagnetically coupled main cavities having approximately the same resonant frequency and plural side cavities. Adjacent ones of the main cavities are electromagnetically coupled to a common side cavity. A beam of charged particles, usually electrons, is injected into the main cavities so the beam travels longitudinally through the cascaded cavities. The cavities are excited with an electromagnetic wave having a frequency that is approximately equal to the resonant frequency of the main cavities so that there is normally a fixed phase shift of 180 degrees between adjacent main cavities.

Such standing wave linear accelerators are widely used for medical, radiation therapy and industrial, radiographic applications. One class of such devices operates in the energy range from 2–5 million electron volts (MeV). To provide for the complete energy range from 2 to 5 MeV, the voltage of the RF applied to the standing wave structure must be changed. However, changing the voltage of the injected microwave energy concommitantly changes the diameter of the particle beam applied to the treated area. It is usually desirable, however, to control the diameter of the particle beam applied to the treated area so that the diameter remains constant for differing energy levels. In other instances, it is desirable to vary the diameter of the output beam irradiating the treated subject matter when there is no change in the beam energy.

DISCLOSURE OF INVENTION

In accordance with the present invention, a linear charged particle beam accelerator having plural cascaded standing wave electromagnetically coupled main cavities with approximately the same resonant frequency and side cavities adjacent and electromagnetically coupled to the main cavities includes at least one side cavity having a resonant frequency different from that of the main cavities. The accelerator is excited by an electromagnetic wave that resonates with the main cavities but not the one side cavity. The non-resonant side cavity causes a change in a normal fixed phase shift of he main cavities adjacent the one side cavity. In particular, there is normally a 180 degree phase shift between adjacent main cavities. However, the phase shift between the main cavities adjacent the non-resonant side cavity is incrementally changed from the normal 180 degree phase shift. Typically, the incremental change is on the order of 10 to 30 degrees.

The non-resonant side cavity decreases the electric field strength in cavities electromagnetically downstream of the non-resonant side cavity relative to the electric field strength in cavities electromagnetically upstream of the side cavity. In one embodiment, the electromagnetic wave is injected into a cavity where a particle beam is upstream of the non-resonant side cavity. In a second embodiment, the electromagnetic wave is injected into a cavity where the particle beam is downstream of the non-resonant side cavity. If it is desired to control the beam diameter and energy, plural non-resonant side cavities can be provided at different longitudinal positions along the propagation path of the beam. Each time the beam encounters a main cavity coupled to a non-resonant side cavity, it suffers a decrease in energy and diameter. The non-resonant side cavities cause a tilt in the directions of the field patterns in the cavities adjacent thereto.

To control the beam energy and diameter, the resonant frequency of the non-resonant side cavities is adjustable at will. The resonant frequency of the non-resonant side cavities is adjusted by an adjusting means within the non-resonant cavities so that the energy of the electromagnetic wave is reflected by a coupling means, such as an iris, between the non-resonant side cavity and the two main cavities to which the side cavity is coupled. The electromagnetic wave is reflected by such coupling means so that non-resonant side cavity loads the two main cavities coupled to it. The adjusting means within the non-resonant side cavities includes a symmetric tuning plunger.

Each side cavity has plural dominant frequencies, one of which is approximately resonant with the frequency of the electromagnetic wave source. The tuning plunger detunes the side cavity from the frequency that is approximately resonant with that of the electromagnetic wave source to achieve the incremental phase shift between adjacent main cavities. Each dominant frequency of the non-resonant side cavity other than the dominant frequency that is approximately resonant with the frequency of the electromagnetic wave source is sufficiently removed from any frequency of the source capable of being coupled by the coupling means to the main cavities to prevent the side cavity from being excited by the wave source.

I am aware of U.S. Pat. Nos. 4,286,192 to Tanabe, and 4,382,208 to Meddaugh et al, both commonly assigned with the present invention. In the Tanabe patent, a standing wave linear accelerator provides accelerated variable energy charged particles over a uniform beam energy spread by provided an adjustable variation of $\pi$ radians in phase shift in a selected side cavity of the accelerator. In particular, the mode of the side cavities is adjusted so that the phase shift introduced between adjacent main cavities is changed from $\pi$ to zero radians. This is accomplished by switching the operation of selected side cavities from a conventional $TM_{010}$ mode in which the magnetic field has the same phase at both coupling irises of the side cavity to a $TM_{011}$ or TEM mode, in which there is a magnetic (H) field phase reversal between the irises of the side cavity. The result is achieved by inserting a metallic tuning rod into the cavity from a sidewall of the cavity, i.e., an asymmetric tuner which changes the dominant mode of the cavity from $TM_{010}$ to $TM_{011}$. The resonant frequency of the cavity is thereby decreased.

The side cavity in the Tanabe structure interacts with the electromagnetic energy of the wve propagating in the standing wave linear accelerator in both the $TM_{010}$ and $TM_{011}$ modes. In contrast, in the present invention, the symmetric tuning plunger is dominant with only one excitation frequency of the linear standing wave accelerator. The resonant frequency of the side cavities in the Tanabe structure decreases linearly when the side cavity is changed from the $TM_{010}$ to the $TM_{011}$ mode. In contrast, in the present invention, there is a monotonic, non-linear decrease in the resonant frequency of the side cavity as the symmetric tuning plunger is inserted into the cavity, toward the beam axis. The non-linear function is higher than of linear order, so that there is a greater decrease in resonant frequency of the side cavity for increasing insertion of the plunger into the cavity with the present invention than with Tanabe. In the present invention, there is a substantial magnetic field in the center of the side cavity in the $TM_{010}$ mode; in the Tanabe structure there is virtually no magnetic field in the center of the side cavity containing the tuning rod which is inserted into the sidewall of the cavity. In the Tanabe structure, the change from the $TM_{010}$ mode to the $TM_{011}$ mode is accomplished by shorting the cavity in response to the tuning plunger being inserted completely across the wall of the side cavity. This causes the phase shift in the adjacent side cavities to change from a 180 degree phase shift to a zero phase shift. In contrast, in the present invention, there is no substantial change in the mode of the side cavity for the excitation frequency of the electromagnetic wave. Instead, the side cavity continues to operate in basically the $TM_{010}$ mode, but it is shifted to a non-resonant condition, causing an incremental phase shift between the cavities adjacent thereto.

In the Meddaugh et al patent, a standing wave particle accelerator includes a structure wherein fields in one part of the circuit are varied by a desired amount with respect to the fields in another part of the circuit. This enables the output particle energy to be varied while the distribution of the particle energies remains unchanged. One side cavity is arranged so that the standing wave electromagentic field in it is asymmetric with respect to coupling elements to the two main cavities adjacent the asymmetric side cavity. The asymmetric relation causes the power coupled to a first coupling iris between the asymmetric side cavity and a first main cavity to be much greater than the power coupled to a second iris between a second main cavity and the asymmetric side cavity. In contrast, in the present symmetric arrangement, the powers coupled through the first and second irises between the detuned side cavity and the main cavities coupled thereto are approximately the same.

While it is known to provide side cavities which include symmetric adjustable tuning plungers, these plungers have previously been adjusted so that the side cavities are resonant to the electromagnetic beam propagating in the linear standing wave accelerator. Hence, no beam and energy control are provided by such structures.

BEST MODE FOR CARRYING OUT THE INVENTION

Figure 1:
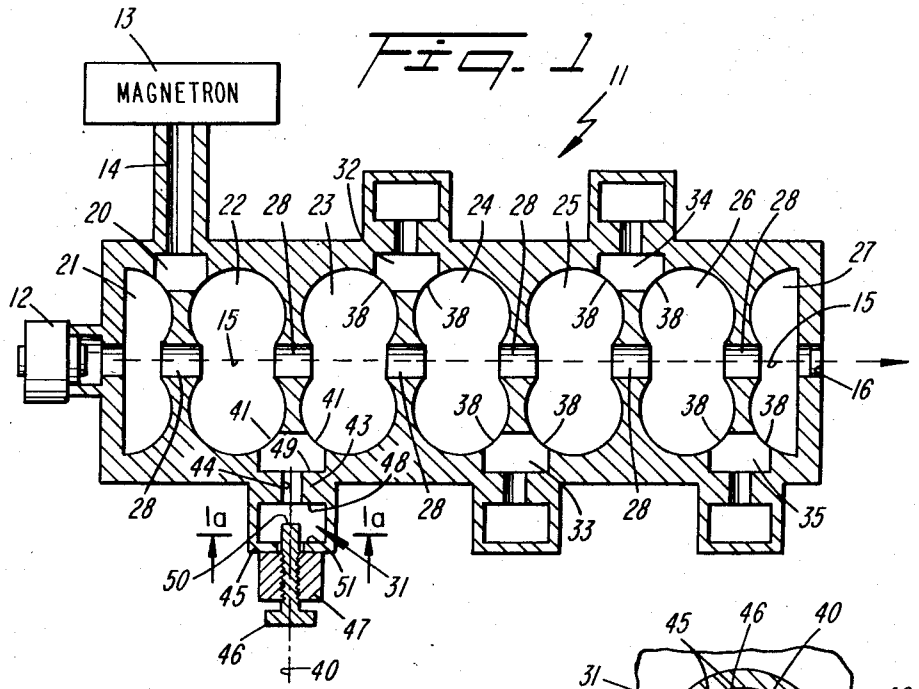
FIG. 1 is a side sectional view of a standing wave linear accelerator having multiple symmetric side cavities, one of which includes a plunger to cause a phase shift between adjacent main cavities to differ from the usual 180 degree amount.

Reference is now made to FIG. 1 of the drawing wherein a linear standing wave particle beam accelerator 11 is illustrated as including electron beam source 12, i.e., the charged particle source, at one end of the accelerator. Source 12 includes means (not shown) for focusing the electrons derived therefrom into a beam that propagates longitudinally of accelerator 11. The beam derived from source 12 has a predetermined diameter, controlled by the energy of the beam, which in the described embodiment, is anywhere in the range from two to five MeV. The electron beam derived from source 12 is accelerated by electric and magnetic microwave fields established in accelerator 11 in response to energy from magnetron 13, having an output in the three gigaHertz (gHz) range. The microwave output of magnetron 13 is coupled to accelerator 11 by feed 14. The interior of accelerator 11 is maintained in a vacuum condition and necessary DC excitation voltages are applied to electrodes of the accelerator as well known to those skilled in the art. Electron beam 15, derived from source 12 and accelerated by structure 11, exits the accelerator through window 16, at the end of the accelerator opposite from electron beam source 12. The electron beam exiting window 16 has a fixed diameter, regardless of energy level, or a variable, controlled diameter for a constant energy level. These desirable results are achieved with the accelerator structure of the present invention.

Accelerator 11 includes multiple cascaded main cavities 21–27 through which beam 15 directly passes as it propagates from electron source 12 to window 16. Input and output cavities 21 and 27, respectively, are half cavities, while the remaining, i.e., intermediate, cavities 22–26 are full cavities. Adjacent ones of cavities 21–27 are connected to each other by longitudinal passages 28, through which electron beam 15 propagates. In the embodiment of FIG. 1, feed 14 is coupled into adjacent main cavities 21 and 20 via side cavity 30, having irises coupled to the feed and the adjacent main cavities. 21. Cavities 21–27 are approximately resonant to the frequency of magnetron 13 that excites accelerator 11.

Adjacent ones of main cavities 22–27 are electromagnetically coupled to each other for the frequency of magnetron 13 by side cavities 31–35, so that cavities 22 and 23 are coupled to each other by cavity 31, cavities 23 and 24 are coupled to each other by cavity 32, cavities 24 and 25 are coupled to each other by cavity 33, cavities 25 and 26 are coupled to each other by cavity 34 and cavities 26 and 27 are coupled to each other by cavity 35. Side cavities 31–35 are approximately resonant to the excitation frequency of magnetron 13. Side cavities 32–35 and main cavities 21–27 interact with each other so that there is a 180 degree phase shift in the electric and magnetic energy in adjacent ones of the main cavities; the electric field and magnetic field in each main cavity are displaced from each other by 90 degrees, i.e., the main cavity is operated in the ($\pi/2$) mode. To this end, each of cavities 32–35 is merely a conventional resonator tuned to the frequency of magnetron 13 and coupled through irises 38 into the main cavities. Cavities 32–35 are symmetrical with respect to the main cavities to which they are coupled.

Side cavity 31, however, is configured different from side cavities 32–35, as a symmetric structure that is detuned from the excitation frequency of magnetron 13. As such, side cavity 31 tilts the fields in main cavities 22 and 23 to which it is coupled by irises 39 so that there is a phase shift between cavities 22 and 23 of $180°+\Delta$, where $\Delta$ is between 10 and 30 degrees. The phase shift introduced by cavity 31 causes a change in the diameter of the electron beam from the time it enters cavity 22 to the time it leaves cavity 23. The electron beam diameter change is associated with an energy level change, such that the beam has a greater diameter and energy prior to entering cavity 22 than it does when it leaves cavity 23. Hence, it is possible to change the diameter of the beam exiting window 16 by changing the resonant frequency of cavity 31; alternatively, the diameter of the beam exiting window 16 can be maintained constant, despite changes in excitation voltage for the beam derived from source 12.

Figure 1A:
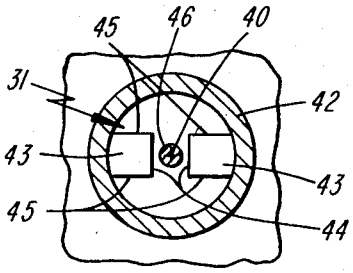
FIG. 1*a* is a sectional view, taken thru the line 1*a*, of a detuned side cavity in the accelerator of FIG. 1.

Cylindrical cavity 31 has a circular cross-section and longitudinal axis 40 transverse to the axis of beam 15, as illustrated in FIGS. 1 and 1*a*. Extending inwardly from circular wall 42 are abutments 43 having opposite end faces 44, on opposite sides of cavity 31. Abutments 43 include side faces 45, at right angles to end faces 44, as well as top face 48 which faces plunger 46, and bottom face 49 which faces irises 41. Top and bottom faces 48 and 49 are equally spaced from a center line of cavity 31 which bisects the longitudinal axis of the cavity, i.e., is equally distant from the bottom plane of the cavity through which plunger 46 extends and the top plane of the cavity which intersects irises 41. Because plunger 46 has a longitudinal axis coincident with cavity longitudinal axis 40 and the cylindrical nature of cavity 31, as well as the placement and symmetrical configuration of abutments 43, the cavity is a symmetric resonant cavity. Cavity 31 has a nominal resonant frequency in the $TM_{010}$ mode that is equal to the resonant frequency of main cavities 21–27 when top end 50 of plunger 46 is coincident with bottom face 51 of cavity 31.

Each of cavities 32–35 is configured generally similar to that of cavity 31, except that cavities 32–35 do not include plunger 46. In consequence, cavities 32–35 are resonant to the same frequency in the $TM_{010}$ mode as main cavities 21–27. In normal operation when control of the diameter and energy of electron beam 15 is desired, cavity 31 is detuned from the resonant frequency of main cavities 21–27 by variable insertion of plunger 46 into cavity 31 so that end 50 of the plunger is remote from end face 51, and is within cavity 31, between end face 51 and end face 48. To this end, plunger 46 is threaded into threaded bore 47 of boss 48 that is fixedly mounted on end wall 45 of cavity 31. Insertion of plunger 46 by differing amounts into cavity 31 changes the cavity resonant frequency, which varies the tilt angles and phase shift of the microwave energy fields in adjacent main cavities 22 and 23.

Figure 2:
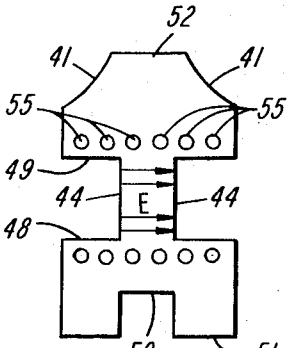
FIG. 2 is a schematic view of said one side cavity in the embodiment of FIG. 1, wherein the electric and magnetic fields are depicted in the $TM_{010}$ mode.
Figure 3:
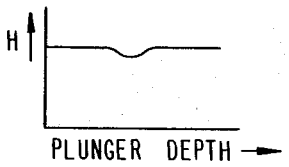
FIG. 3 is a plot of electric field strength versus length in the side cavity of FIG. 2.
Figure 4:
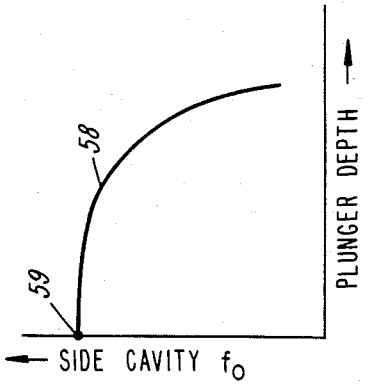
FIG. 4 is a plot of the resonant frequency of said one side cavity as a function of plunger depth.

Reference is now made to FIGS. 2–4 of the drawing wherein details of the operation of cavity 31 are illustrated. As illustrated in FIG. 2, a relatively uniform electric field E subsists between end faces 44 of abutments 43, in the center of cavity 31. Electric field lines 54 extend in a direction at right angles to longitudinal axis 40 of cavity 31 and uniformly fill the gap between end faces 44. Magnetic field lines 55 encircle abutments 43 and to a slightly lesser extent the gap between abutment end faces 44 where electric field lines 44 subsist. Magnetic flux lines 55 lie in planes that are generally parallel to longitudinal axis 40 of cavity 31.

As indicated in FIG. 3, the magnetic field, H, in cavity 31 is relatively constant between the cavity cylindrical end wall 42, with only a slight dip in the center of the cavity. This is in contrast to the configuration disclosed in the side cavities of the previously mentioned Tanabe and Meddaugh et al patents. In the side cavities of Tanabe and Meddaugh et al, the magnetic field drops virtually to zero in the center of the cavities.

Cavity 31 is excited by the microwave field to the $TM_{010}$ mode. Typically, magnetron 13 supplies microwave energy at 3 gHz to accelerator 11, and the nominal resonant frequency of cavity 31 is also 3 gHz. Cavity 31 is constructed so that the next dominant frequency thereto, typically in excess of 5 mHz, is outside of the frequency band applied by magnetron 13 to accelerator 11. In contrast, in the structures disclosed by Tanabe and Meddaugh et al, the side cavities have dominant frequencies that are within the frequency band applied by a microwave source to the accelerator. For example, the side cavities of Tanabe and Meddaugh et al are dominant in the $TM_{010}$ mode at 3 gHz and in the $TM_{011}$ mode at 3.2 gHz.

The resonant frequency of cavity 31 in the $TM_{010}$ mode decreases as a monotonic higher order non-linear function as the depth of plunger 46 into cavity 31 increases, as indicated by curve 58, FIG. 4. In FIG. 4, the resonant frequency of side cavity 31 for the $TM_{010}$ mode is plotted as a function of the depth of plunger 46 into cavity 31. When plunger end 50 is in the same plane as end face 51 of cavity 31, as indicated by point 59 on curve 58, cavity 31 is at its normal resonant frequency in the $TM_{010}$ mode. As plunger 46 is moved into cavity 31, the resonant frequency of the cavity in the $TM_{010}$ mode initially decreases by a small amount. The rate of change of decrease of the resonant frequency of cavity 31 as a function of plunger depth increases substantially as the plunger is inserted by increasing amounts into cavity 31. This results in a significant change in the phase shift between adjacent cavities 22 and 23 to achieve the desired beam energy and/or diameter. In the Tanabe and Meddaugh et al structures the side cavity resonant frequency decreases linearly as the side tuning plunger is inserted, whereby the total frequency change of the present invention is greater, while achieving high resolution for small resonant frequency changes.

Figure 5:
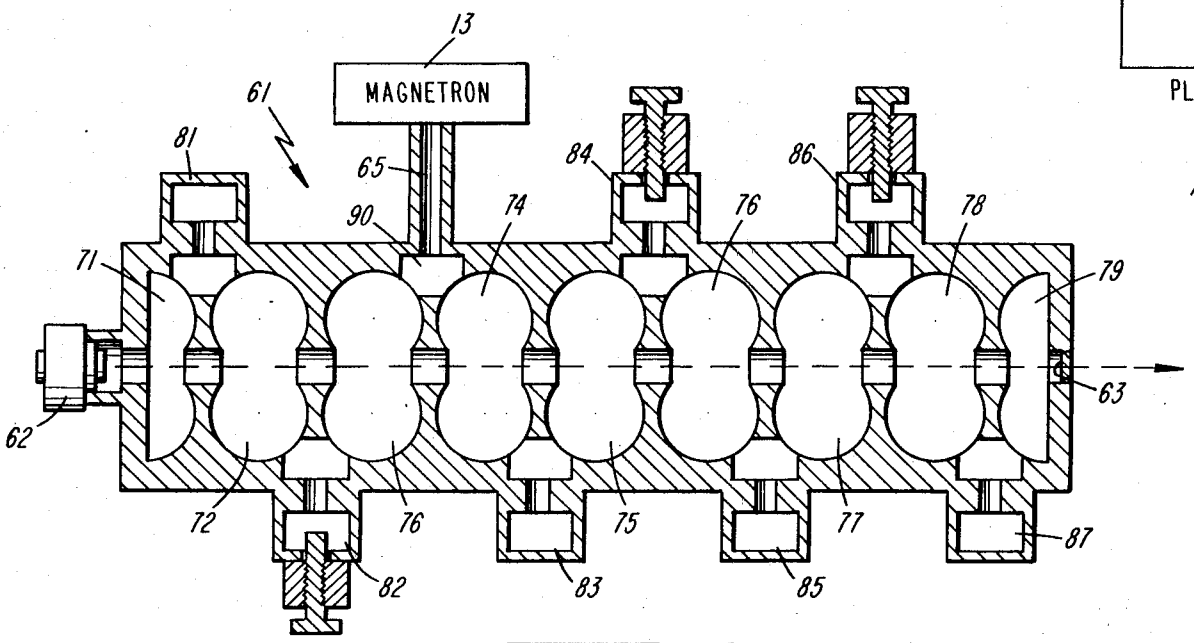
FIG. 5 is a side view of a second embodiment of the invention.

Reference is now made to FIG. 5 of the drawing wherein there is illustrated a second embodiment of the invention wherein microwave energy from magnetron 13 is injected into the waist or central portion of the linear standing wave accelerator 61. Accelerator 61 includes multiple main cavities and multiple resonant side cavities. The main cavities are resonant to the frequency of magnetron 13 as are the majority of the side cavities. However, three of the side cavities of accelerator 61 can be detuned from a resonant condition. In the specifically illustrated configuration, one of the detunable side cavities is between electron beam source 62 and feed 65 for the output of magnetron 13 into the waist of accelerator 61, while the remaining detunable cavities are between feed 65 and window 63 for electron beam 64 that is supplied to the interior of accelerator 61 by electron beam source 62.

In the particularly illustrated configuration, accelerator 61 includes cascaded resonant main sections 71–79, all of which are approximately resonant to the frequency of magnetron 13. Entrance and exit cavities 71 and 79 are half cavities, while the remaining, intermediate cavities 72–78 are full cavities. Coupled between adjacent ones of cavities 71–79 are side cavities 81–87 such that cavity 81 is coupled between cavities 71 and 72, cavity 82 is coupled between cavities 72 and 73, cavity 83 is coupled between cavities 74 and 75, cavity 84 is coupled between cavities 75 and 76, cavity 85 is coupled between cavities 76 and 77, cavity 86 is coupled between cavities 77 and 78, and cavity 87 is coupled between cavities 78 and 79. Microwave energy is injected by feed 65 into adjacent main cavities 73 and 74 via side cavity 90, having irises coupled to the feed and the adjacent side cavities. Cavities 81, 83, 85 and 87 are fixed cavities, constructed in the same manner as fixed cavities 32–35, FIG. 1. In contrast, cavities 82, 84 and 86 are symmetrical cavities having variable resonant frequencies, constructed in the same manner as variable cavity 31, FIG. 1. Fixed cavities 81, 83, 85 and 87 are resonant to the same frequency as main cavities 71–79. Variable side cavities 82, 84 and 86 are adjusted so that they are detuned from the resonant frequency of the main cavities to provide control of the beam diameter and energy exiting window 63.

At each detuned side cavity location, electromagnetic energy is coupled back into the main cavities coupled to the side cavity to decrease beam energy and diameter as the beam propagates from electron beam source 62 to window 63. The decreases occur regardless of whether the microwave energy is propagating in a forward or backward manner, i.e., the microwave energy propagates in a backward manner from magnetron 13 and feed 65 toward electron beam source 62 and propagates in a forward manner from feed 65 toward window 63. Hence, there is a first decrease in the beam diameter and energy level from the time the beam enters cavity 72 to the time it exits cavity 73, between which detuning cavity 82 is located; there is a second decrease in beam energy and diameter between the time the beam enters cavity 75 and exits cavity 76, between which detuning side cavity 84 is located; and there is a third decrease in beam diameter and energy between the time the beam enters cavity 77 and exits cavity 78, between which detuning cavity 86 is located. Of course, the number and location of the detuning cavities can be selected in accordance with the necessary criteria for controlling beam diameter and energy level.

While there have been described and illustrated several specific embodiments of the invention, it will be clear that variations in the details of the embodiments specifically illustrated and described may be made without departing from the true spirit and scope of the invention as defined in the appended claims.

I claim:

1. A method of operating a linear charged particle beam accelerator having: plural cascaded standing wave electromagnetically coupled main cavities with approximately the same resonant frequency, and side cavities, adjacent ones of the main cavities being electromagnetically coupled to a common side cavity, comprising the steps of injecting a beam of the particles into the main cavities so the beam travels longitudinally through the cascaded cavities, exciting the cavities with an electromagnetic wave having a frequency that is approximately resonant with the resonant frequency of the main cavities so that there is normally a fixed phase shift of the electromagnetic energy in adjacent main cavities, adjusting the resonant frequency of the side cavity so it is not resonant with the electromagnetic wave, and so that a side cavity adjacent said one side cavity is resonant with the electromagnetic wave, the non-resonant one side cavity causing: (a) a change in the normal fixed phase shift of the main cavities adjacent said one side cavity, and (b) a decrease in electric field strength in cavities electromagnetically downstream of said one side cavity relative to the electric field strength in cavities electromagnetically upstream of said one side cavity.

2. The method of claim 1 further including adjusting the frequency of a second side cavity so it is not resonant with the electromagnetic wave, a side cavity adjacent said second side cavity being resonant with the electromagnetic wave, the second side cavity resonant frequency causing: (a) a change in the normal fixed phase shift of the main cavities adjacent said second side cavity, and (b) a decrease in electric field strength in cavities electromagnetically downstream of said second side cavity relative to the electric field strength in cavities electromagnetically upstream of said second side cavity.

3. The method of claim 1 wherein a side cavity adjacent said one side cavity is resonant with the electromagnetic wave and decrease in electric field strength in cavities electromagnetically downstream of said one side cavity relative to the electric field strength in cavities electromagnetically upstream of said one side cavity, a side cavity adjacent said second side cavity is resonant with the electromagnetic wave.

4. The method of claim 1 wherein the electromagnetic wave is injected into a cavity so it is not resonant with the electromagnetic wave, where the particle beam is upstream of said one side cavity.

5. The method of claim 1 further including adjusting the frequency of a second side cavity so it is not resonant with the electromagnetic wave, a side cavity adjacent said second side cavity being resonant with the electromagnetic wave, the second side cavity resonant frequency causing: (a) a change in the normal fixed phase shift of the main caivities adjacent said second side cavity, and (b) a decrease in electric field strength in cavities electromagnetically downstream of said second side cavity relative to the electric field strength in cavities electromagnetically downstream of said second side cavity.

6. A linear standing wave charged particle beam accelerator comprising a beam source of the particles, plural cascaded standing wave electromagnetically coupled main cavities with approximately the same resonant frequency and side cavities, the main cavities being positioned so that the particle beam propagates longitudinally through them, adjacent ones of the main cavities being electromagnetically coupled to a common side cavity, and means for coupling the main cavities to be responsive to an electromagnetic wave having a frequency that is approximately resonant with the resonant frequency of the main cavities so that there is normally a fixed phase shift of the electromagnetic energy in adjacent main cavities, the resonant frequency of one side cavity being arranged so it is not resonant with the electromagnetic wave, the one side cavity resonant frequency causing: (a) a change in the normal fixed cavity having a resonant frequency adjusted so it is not reson with the electromagnetic wave, the second side cavity resonant frequency causing: (a) a change in the normal fixed phase shift of the main cavities adjacent said second side cavity, and (b) a decrease in electric field strength in cavities electromagnetically downstream of said second side cavity relative to the electric field strength in cavities electromagnetically upstream of said second side cavity.

7. The linear standing wave particle beam accelerator of claim 6 wherein the coupling means is connected to a main cavity where the particle beam is upstream of said one side cavity.

8. The linear standing wave particle beam accelerator of claim 6 wherein said one side cavity includes means for adjusting the resonant frequency of said one side cavity and electromagnetic coupling means between said one side cavity and the two main cavities adjacent thereto, the resonant frequency being adjusted by said adjusting means so that the energy of the electromagnetic wave is reflected by said coupling means between said one side cavity and the main cavities adjacent thereto and said one side cavity loads the two main cavities adjacent thereto.

9. The linear standing wave particle beam accelerator of claim 8 wherein the means for adjusting includes a symmetric tuning plunger.

10. The linear standing wave particle beam accelerator of claim 6 wherein the side cavity has plural dominant frequencies, one of said dominant frequencies being approximately resonant with the frequency of the electromagnetic wave source, each dominant frequency other than said one dominant frequency being sufficiently removed from any frequency of the electromagnetic wave source capable of being coupled by the coupling means to the main cavities to prevent the side cavity to be excited by the wave source.

11. The linear standing wave particle beam accelerator of claim 6 wherein the coupling means is connected to a main cavity where the particle beam is downstream of said one side cavity.

* * * * *